US007476008B2

(12) United States Patent
Kay

(10) Patent No.: US 7,476,008 B2
(45) Date of Patent: Jan. 13, 2009

(54) RECESSED LIGHT FIXTURE

(75) Inventor: Gregory L. Kay, Chicago, IL (US)

(73) Assignee: Lightology, LLC, Chicago, IL (US)

( * ) Notice: Subject to any disclaimer, the term of this patent is extended or adjusted under 35 U.S.C. 154(b) by 203 days.

(21) Appl. No.: 11/440,961

(22) Filed: May 25, 2006

(65) Prior Publication Data

US 2007/0274082 A1 Nov. 29, 2007

(51) Int. Cl.
*F21V 15/00* (2006.01)

(52) U.S. Cl. ..... 362/364; 362/147

(58) Field of Classification Search ..... 362/147, 362/364

See application file for complete search history.

(56) References Cited

U.S. PATENT DOCUMENTS

| | | | | |
|---|---|---|---|---|
| 2,597,595 | A | 5/1952 | Ordas | |
| 5,609,408 | A * | 3/1997 | Targetti | 362/523 |
| 6,814,471 | B1 * | 11/2004 | Stoner | 362/364 |
| 2003/0007354 | A1 | 1/2003 | Schubert et al. | |
| 2003/0161153 | A1 | 8/2003 | Patti | |
| 2005/0002191 | A1 * | 1/2005 | Shimizu et al. | 362/237 |

FOREIGN PATENT DOCUMENTS

| | | |
|---|---|---|
| DE | 93 16 780 U1 | 1/1994 |
| EP | 1 657 486 A1 | 5/2006 |

* cited by examiner

*Primary Examiner*—Sandra O'Shea
*Assistant Examiner*—James W Cranson
(74) *Attorney, Agent, or Firm*—Wood, Phillips, Katz, Clark & Mortimer

(57) ABSTRACT

A recessed light fixture including a base plate mountable in an opening in a room ceiling or wall, with the base plate having a front surface substantially flat and aligned with the ceiling or wall surface when mounted thereon, and a light opening through the base plate wherein the edge of the light opening is a sharp edge with the back surface tapering away from the front surface around the light opening at an angle of less than 45 degrees. A curved dome is adjacent the base plate back surface and centered on the light opening. A ring is mounted to the base plate for selected rotation around the light opening, and a support track between the curved dome and the base plate is secured on its lower end to the ring and curved up and toward the light opening from its lower end. A socket support is mounted for adjustable movement on the support track, and a light socket is mounted to the socket support whereby a lamp in the socket emits light through the light opening.

28 Claims, 6 Drawing Sheets

RECESSED LIGHT FIXTURE

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to lighting fixtures, and more particularly to recessed lighting fixtures.

BACKGROUND OF THE INVENTION AND TECHNICAL PROBLEMS POSED BY THE PRIOR ART

Recessed lighting systems are well known. Such systems provide a light source from behind the surface or a wall or ceiling, and therefore do not protrude into the room to any great degree but instead locate the light components in space behind the wall or ceiling.

Such systems are desirable for a variety of reasons, one significant one being that they do not visually intrude significantly into the appearance of the room and therefore may readily blend with almost any decor. Notwithstanding this, many recessed lights are far from being hidden from notice.

For example, many recessed lighting fixtures include a frame, a reflector, a junction box and structure for attaching the frame to the ceiling. The junction box is typically required by code, and is an enclosure mounted on the frame that functions as a receptacle for joining the wires from an electrical power source and a lamp socket in the reflector. The frame is suitably mounted to the ceiling (e.g., by a barbed insert that can be nailed into a wooden beam in the ceiling) and includes an opening through which the reflector is inserted to direct light to an area below the lighting fixture (e.g., down at an angle away from the lighting fixture or down from the lighting fixture). Different mechanisms have been used to retain the reflector in the frame. For example, the reflector may have an opening with a circumference that is larger than the opening in the frame. In such a configuration, the reflector sits on the top surface of the frame and surrounds the opening with a trim ring that is readily visible to anyone in the room. Further, the reflector visible through the wall or ceiling opening will often be silver or some other color which may functionally reflect light but will also provide an obvious visible contrast with the wall or ceiling around it.

A recessed lighting fixture of the above general type is shown, for example, in U.S. Pat. No. 6,431,723

Another reason is that recessed lighting systems are desirable is that they may provide more indirect lighting, thereby reducing the glare from the light source (e.g., an incandescent lamp). However, in many such systems, the lights are often still readily visible from many different positions in the room and, particularly given the brightness of spotlights often used in such systems, can cause a person who happens to look into the fixture discomfort and some disorientation due to closing of their irises and therefore insufficient dilation of their irises when they look away from the light.

In short, while recessed lighting systems provide many different types of advantages, those long desired advantages still have not been fully provided.

The present invention is directed toward overcoming one or more of the problems set forth above.

SUMMARY OF THE INVENTION

In one aspect of the present invention, a recessed light fixture is provided, including a base plate mountable in an opening in a room ceiling or wall and defining a light opening therethrough, and a light socket mounted to the base plate back surface whereby a lamp in the socket emits light through the light opening. The base plate front surface is substantially flat and aligned with the surface of the ceiling or wall when mounted thereon, and the edge of the light opening is a sharp edge with the back surface tapering away from the front surface around the light opening.

In one form of this aspect of the present invention, the back surface tapers from the front surface at an angle of less than 45 degrees, and in a further form the back surface tapers from the front surface at an angle of about 15 degrees.

In another form of this aspect of the present invention, a curved dome is adjacent the back surface of the base plate and centered on the light opening, wherein the light socket is between the curved dome and the base plate. In a further form, the dome surface facing the base plate and the base plate front surface when mounted on the ceiling or wall have substantially the same color. In another further form, a plurality of light emitting diodes are around the light opening and directed toward the curved dome, and a still further form there is a control for selecting the color of light emitted by the light emitting diodes.

In still another form of this aspect of the present invention, a mount for the light socket includes a support track secured on its lower end to the base plate and curved up and toward the light opening from its lower end, and a socket support mounted for adjustable movement on the support track. In a further form, the track is a curved rack and the socket support comprises a pinion secured for movement along the rack in response to pivoting of the pinion, with a worm on the socket support engaging the pinion for pivoting thereof, the worm having a drive accessible through the light opening in a still further form, and the worm drive being a slotted head in yet a further form. In another further form, the lower end of the support track is rotatable around the light opening, with a ring rotatably mounted to the base plate with the lower end of the support track secured to the ring in a still further form, LEDs on the ring emit light away from the back plate in yet a further form, and in yet a further form still a curved dome is adjacent the back surface of the base plate and centered on the light opening, wherein the light socket is between the curved dome and the base plate.

In yet another form of this aspect of the present invention, the track is curved substantially about the center of the light opening.

In another aspect of the present invention, a recessed light fixture is provided, including a base plate defining a light opening therethrough and mountable in an opening in a room ceiling or wall, a support track secured on its lower end to the base plate and curved up and toward the light opening from its lower end, a socket support mounted for adjustable movement on the support track, and a light socket mounted to the socket support whereby a lamp in the socket emits light through the light opening.

In one form of this aspect of the present invention, the track is a curved rack and the socket support comprises a pinion secured for movement along the rack in response to pivoting of the pinion. In a further form, a worm on the socket support engages the pinion for pivoting thereof with the worm having a drive accessible through the light opening, and in a still further form the worm drive is a slotted head.

In another form of this aspect of the present invention, the lower end of the support track is rotatable around the light opening. In a further form, a ring is rotatably mounted to the base plate with the lower end of the support track secured to the ring, and in a still further form LEDs on the ring emit light away from the back plate.

In still another aspect of the present invention, a recessed light fixture includes a base plate mountable in an opening in a room ceiling or wall, with the base plate defining spaced apart front and back surfaces wherein the front surface is substantially flat and aligned with the surface of the ceiling or wall when mounted thereon, and a light opening through the base plate wherein the edge of the light opening is a sharp edge with the back surface tapering away from the front surface around the light opening at an angle of less than 45 degrees. The fixture further includes a curved dome adjacent the back surface of the base plate and centered on the light opening. A ring is mounted to the base plate for selected rotation around the light opening, and a support track between the curved dome and the base plate is secured on its lower end to the ring and curved up and toward the light opening from its lower end. A socket support is mounted for adjustable movement on the support track, and a light socket is mounted to the socket support whereby a lamp in the socket emits light through the light opening.

In one form of this aspect of the present invention, the track is an arcuate rack and the socket support comprises a pinion secured for movement along the rack in response to pivoting of the pinion. In a further form, a worm on the socket support engages the pinion for pivoting thereof with the worm having a drive accessible through the light opening. In another further form, LEDs on the ring emit light away from the back plate.

In another form of this aspect of the present invention, the back surface tapers from the front surface at an angle of about 15 degrees.

BRIEF DESCRIPTION OF THE DRAWINGS

FIG. 6 is a top view;

FIG. 7 is a perspective view;

FIG. 8 is a side view; and

FIG. 9 is a detailed view of portion A of FIG. 8.

DETAILED DESCRIPTION OF THE INVENTION

Figure 1:
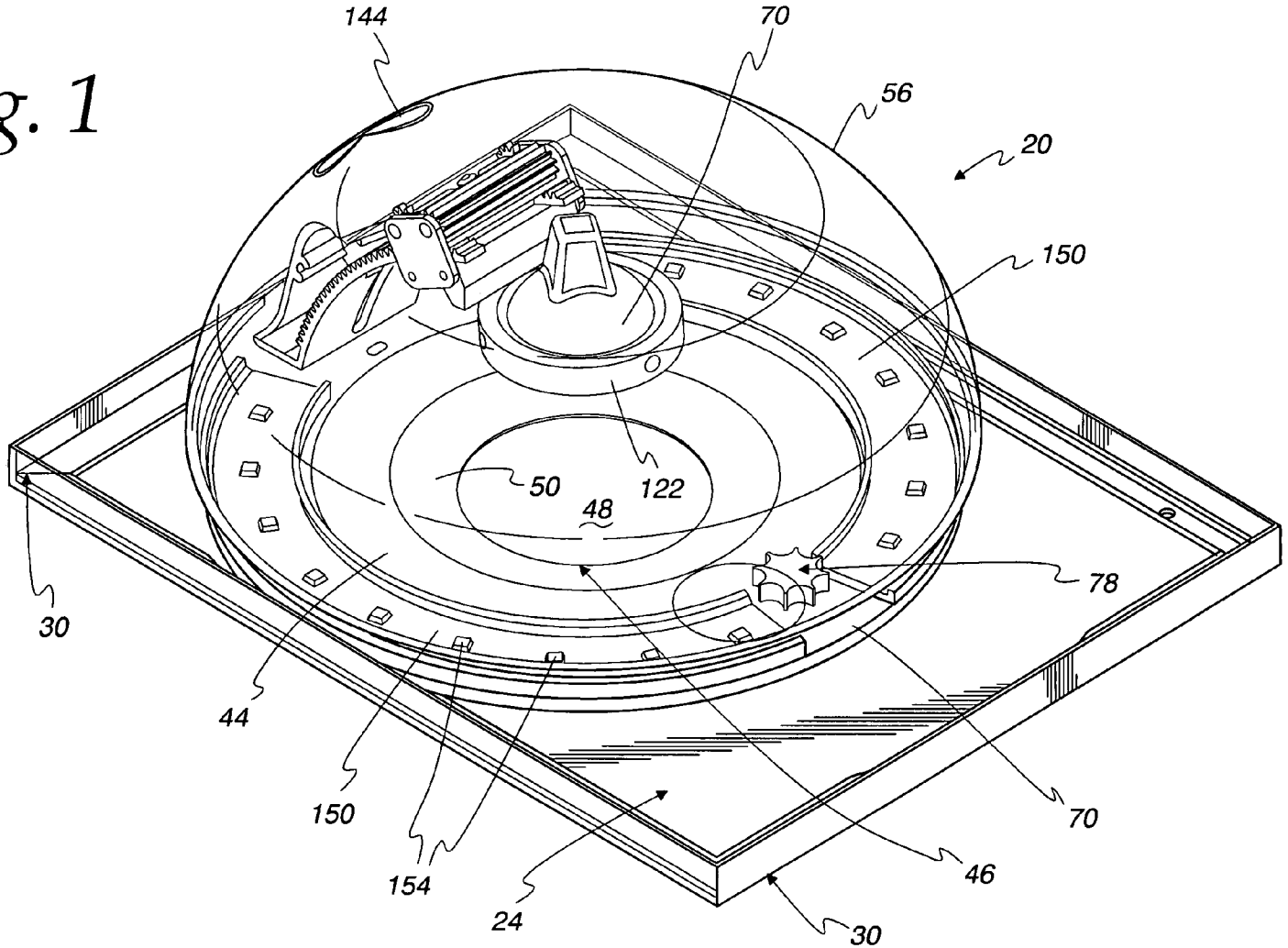
FIG. 1 is a perspective view of a light fixture according to the present invention with the dome thereof shown transparent for illustration purposes.

A recessed light fixture 20 incorporating various aspects of the present invention is illustrated in FIG. 1. As illustrated in the Figures and as described herein, the fixture 20 is oriented as it would be when mounted in an opening in a ceiling, with its bottom being substantially horizontal and facing down into the room beneath the ceiling. However, it should be understood that fixtures according to the present invention could also be used in slanted ceilings, or in vertical walls as well, and thus references to up, down, bottom, horizontal, etc. in the description herein should not be taken as limiting of the invention to only horizontal ceiling installations.

The fixture 20 includes a base plate 24 with a substantially flat bottom or front surface 26, and a frame 30 around the peripheral edge of the plate 24. The frame 30 may be advantageously made, for example, of aluminum, and may be secured to a suitable junction box 32 (see FIG. 2) such as is required by most codes.

Figure 3:
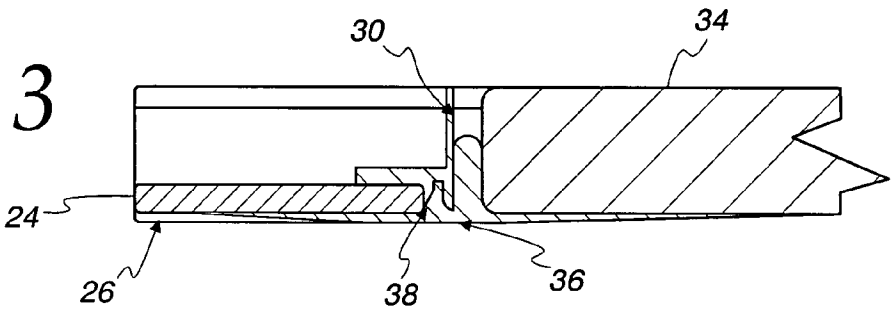
FIG. 3 is a cross-sectional view of the connection of the base plate of the light fixture of FIG. 1 to a ceiling.

As illustrated in FIG. 3, the fixture 20 may be mounted in an opening in a wall or ceiling 34 so as to be supported with the front surface 26 of the plate 24 substantially aligned with the surface of the wall or ceiling 34. The material of the plate 24 may be particularly suited to adhere to plaster to facilitate installation of the fixture 20 by enabling plaster 36 to be readily applied to hide the joint between the plate 24 and the ceiling 34. The frame 30 provides structural strength to the fixture 20 and further may be used to facilitate plastering the joint by providing a groove 38 to grip the joint plaster 36.

An opening 40 is defined through the base plate 24 and a separate edge plate 44 is located in the plate opening 40. The edge plate 44 defines a smooth edge 46 for a light opening 48 so that light from behind the plate 24 may project out the light opening 48 and into the room beneath the ceiling 34.

While a separate edge plate 44 is illustrated, it should be appreciated that the base plate 24 could itself define the light opening 48 within the scope of the present invention. However, the use of a separate edge plate 44 permits different materials to be used for the two plates 24,44, and further permits the smooth edge 46 to be protected again damage when the base plate 24 is separately handled prior to installation.

In accordance with one aspect of the present invention, the edge 46 is a sharp edge 46 in which the back surface 50 of the plate 44 tapers away from the plate front surface 26 so as to present virtually no thickness (i.e., virtually no vertically extending surface around the light opening 48) to anyone looking into the light opening 48 from the room below. For example, in a room with eight foot ceilings, a standing person of normal height would have their eyes at a level about 2½ feet or more below the ceiling 34 and would not see any of a 15° tapered back surface unless they stood at least about ten feet away from the location of the edge 46. Such a person standing within 10 feet would, upon looking up at the light opening 48, see only the sharp, smooth edge 46 of the light opening 48 with no visible thickness at the edge 46, giving the visual effect of there being nothing there, which itself is a striking visual effect and, when used in conjunction with other features described below, allows for further striking visual effects. It should also be appreciated that even though a person standing more than ten feet away from the fixture 20 would theoretically be able to see a sliver of the back surface 48, at that distance such small details will be difficult for most people to discern anyway. Therefore, given standards room sizes and ceiling and person heights, a taper of about 15° would give the above described visual effect and thus tapers in that range would be a suitable standard. However, it should be appreciated that different tapers of the back surface 48 (e.g., tapers up to 45°) from the sharp edge 46 could advantageously be used in different rooms; for example, a taper greater than 15° could provide similar visual effects in rooms in which the ceiling is higher than eight feet.

In accordance with another aspect of the present invention, a curved dome 56 is mounted (as described further below) to be supported over, and substantially centered on, the light opening 48. While shown as translucent in the Figures for illustration purposes, the dome 56 may advantageously be of the same color as the ceiling 34. In conjunction with the nearly invisible sharp edge 46 of the light opening 48 as previously described, this can have the effect of causing the opening 48 to be noticeable only upon close scrutiny, as a person in the room may not notice the opening 48 in their peripheral vision. Further, it should be appreciated that a dome 56 having the color of the ceiling will not provide the eye-hurting kind of glare occurring as a result of the bright light coming from reflectors typically found heretofore in recessed lighting fixtures.

Specific lighting may also be advantageously provided to the inside surface of the dome 56 itself whereby, as one example, any shadow within the dome 56 which may make it appear darker than the surrounding ceiling 34 may be removed. Moreover, selected colored lighting (as described further below) may be provided inside the dome 56 to provide an accent to a room. In such a case, it should further be appreciated that the dome 56 gives the perception of little or no depth so that, together with the previously described sharp edge 46, a colored light will give the appearance of being a glowing portion of the ceiling 34 itself.

It is worth noting here that, while it may appear from the Figures that a lamp is itself centered directly over the light opening 48 and that, therefore, whatever "invisibility" effect may occur as described above would be lost by the presence of the lamp. However, as further described below, the lamp may be advantageously mounted for easy movement between different positions other than the one centered over the opening 48 as illustrated in the Figures. In those other lamp positions (e.g., when the fixture 20 is mounted in the ceiling 34 adjacent a wall, the lamp may be moved off to the side away from the wall and tilted to provide highlighting light on the wall, and in such position a person standing away from the wall and looking up at the fixture 20 would not see the lamp within the dome 56 at all.

Mounting of a socket 70 for a light bulb or lamp is illustrated in the Figures, particularly FIGS. 6-9.

Specifically, a ring 74 is suitably mounted to the base plate 24 for rotational adjustment relative to the base plate 24. A round guide may be provided if desired to ensure that the ring 74 is concentric with the light opening 48. Further, a suitable locking opening 76 may be provided in the ring 74 for receiving a locking screw 78 (with a knob handle 80) to secure the position of the ring 74 in any suitable manner when desired.

A socket mount 100 includes a support track 104 secured on its lower end to the ring 74, with the track 104 being curved up and toward (over) the light opening 48. A socket support 110 includes a carriage 114 which includes a base 116 connected by side frame members 118 to a pair of pinion gears 120 (see particularly FIG. 9).

A suitable mounting member 122 is secured to the carriage 114 and is adapted to mount a lamp socket 70. As illustrated, the mounting member 122 consists of a simple collar which may secure a socket 70 therein in any suitable manner, such as set screws.

The track 104 may advantageously consist of two spaced but matching curved racks 124, with the carriage 114 mounted thereto with the base 116 slidable along the curved but smooth underside of the racks 124 and the pinion gears 120 engaging the other side of the racks 124 to trap the carriage 114 thereon. A worm gear 130 extends from driving engagement with the pinion gears 120 through the space between the racks 124 and through the base 116, whereby its lower end 132 includes a drive such as a slotted head and is accessible through the light opening 48 by, for example, a screwdriver, so that adjustment of the carriage 114 along the track 104 may be readily accomplished by simple turning of the worm gear 130. Frictional forces between the track 104 and carriage components may suitably retain the carriage 114 in the selected position on the track 104.

Figure 4:
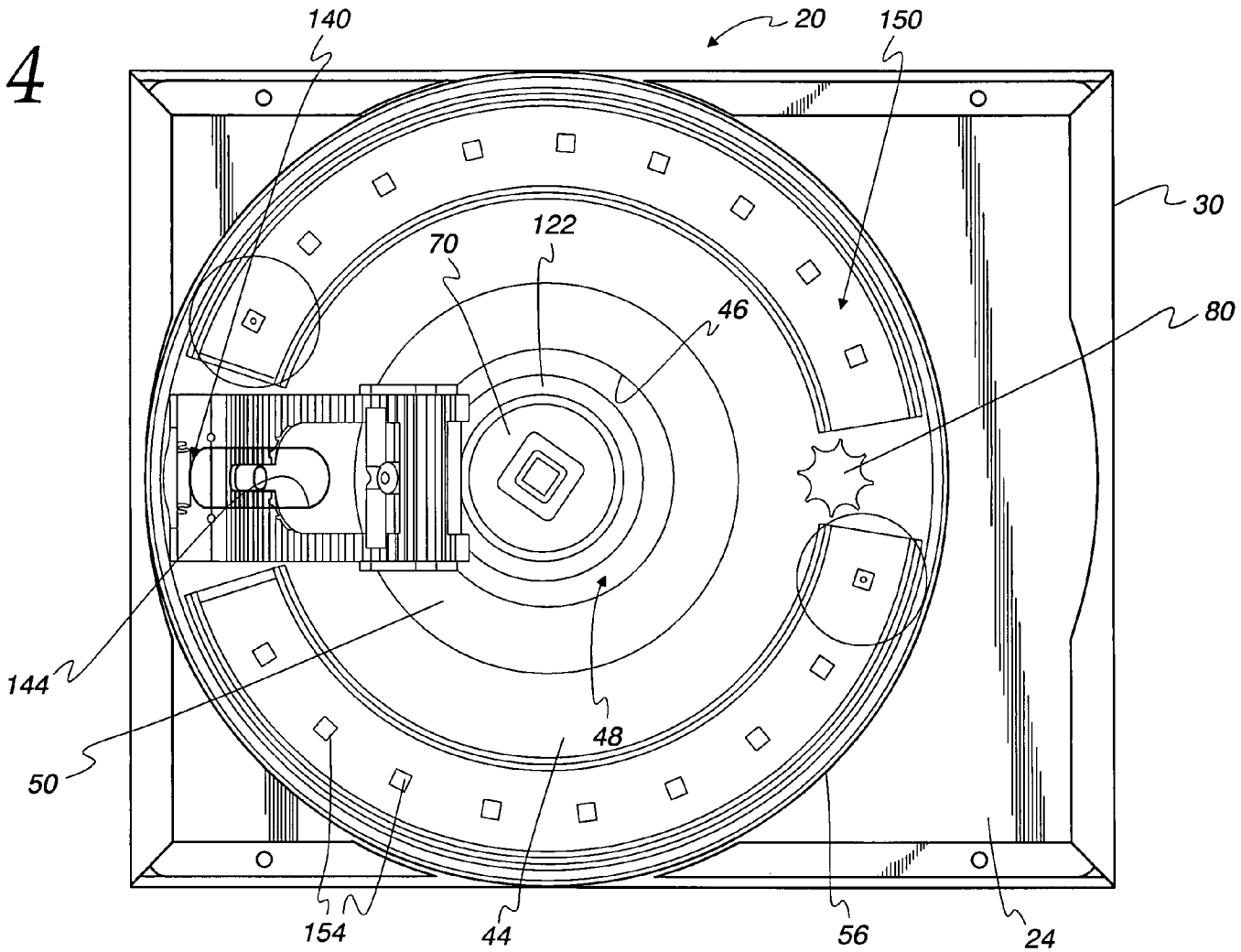
FIG. 4 is a top view of the FIG. 1 light fixture.
Figure 5:
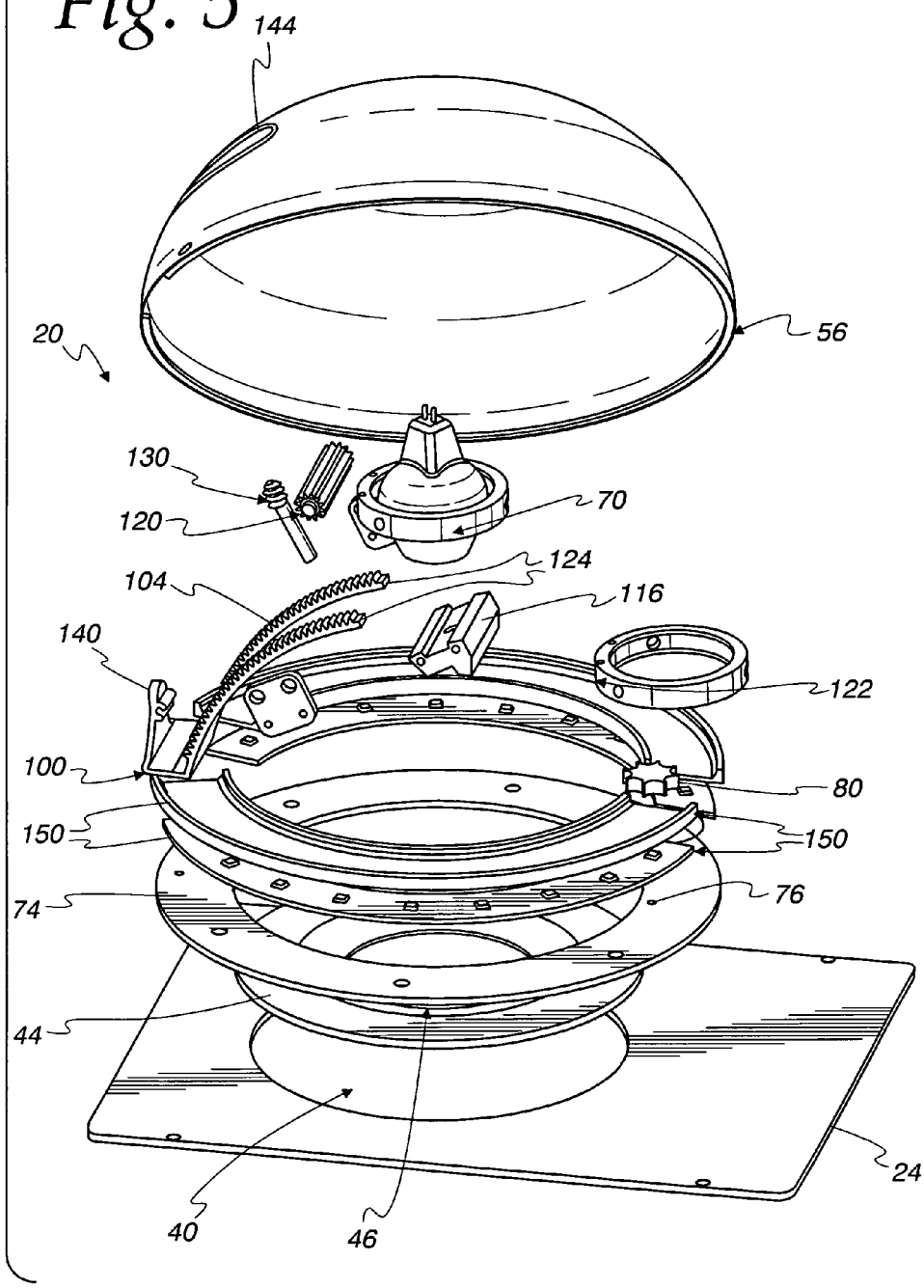
FIG. 5 is an exploded view of the FIG. 1 light fixture.
Figure 6:
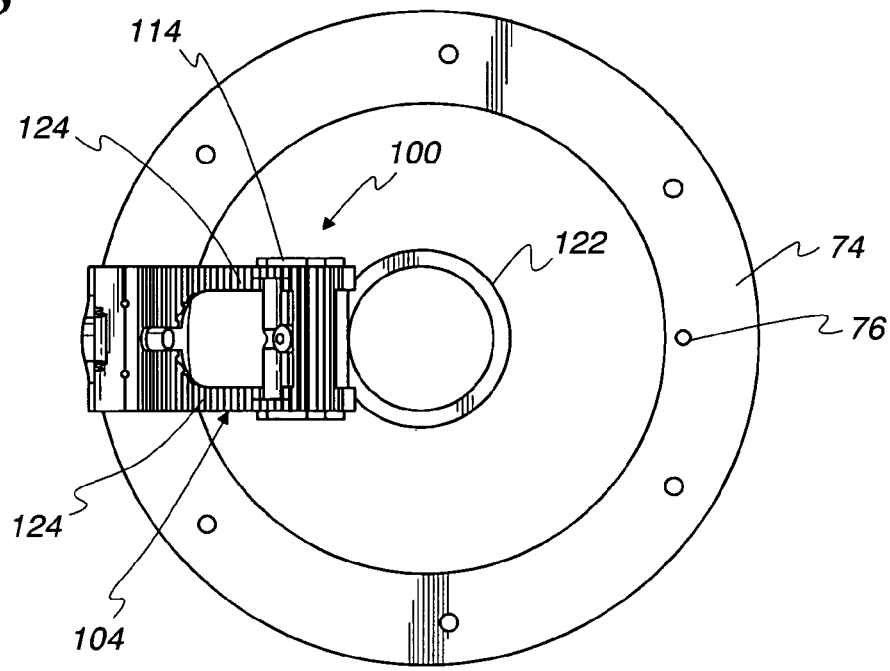
FIGS. 6-9 illustrate the mount for the FIG. 1 light fixture, where.
Figure 7:
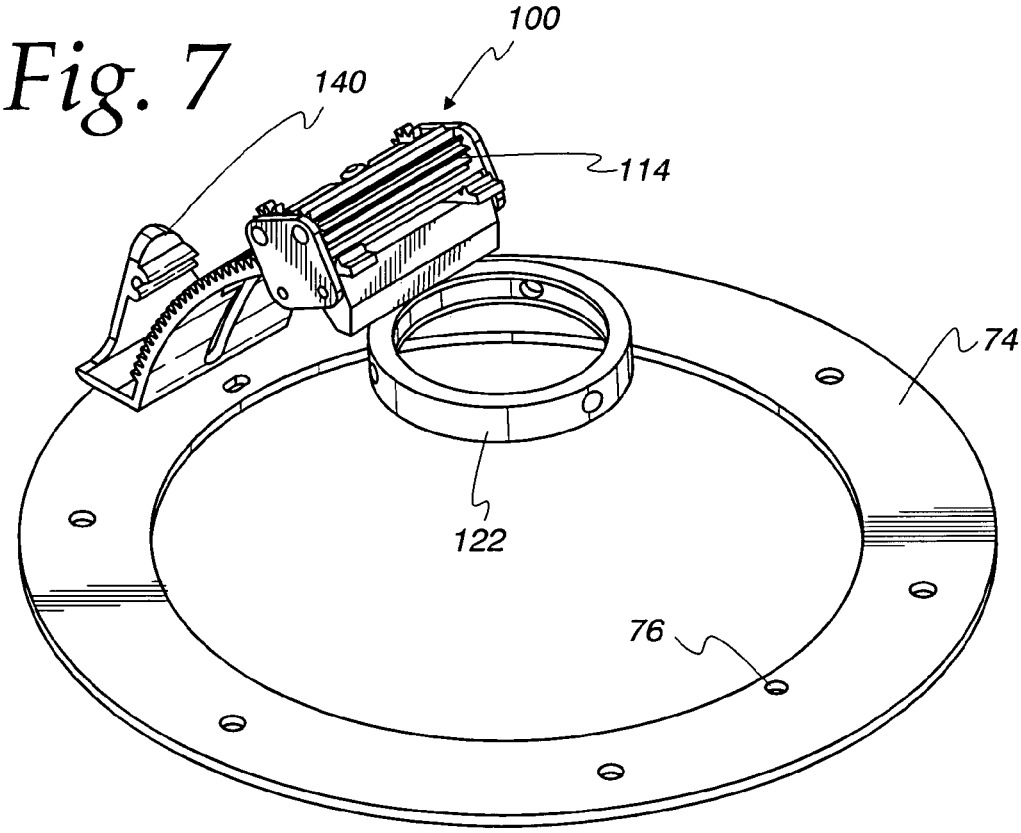
Figure 8:
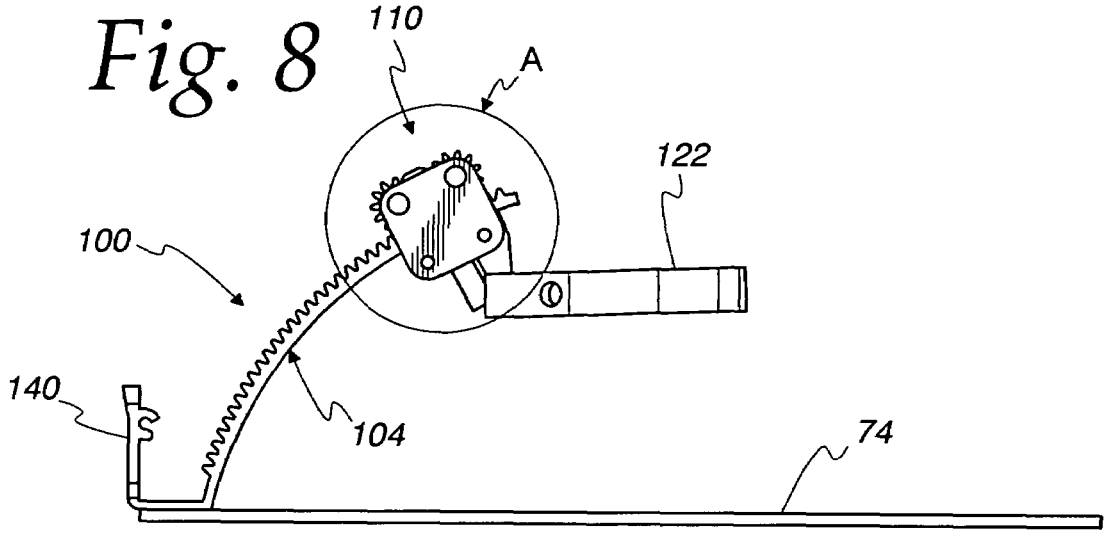
Figure 9:
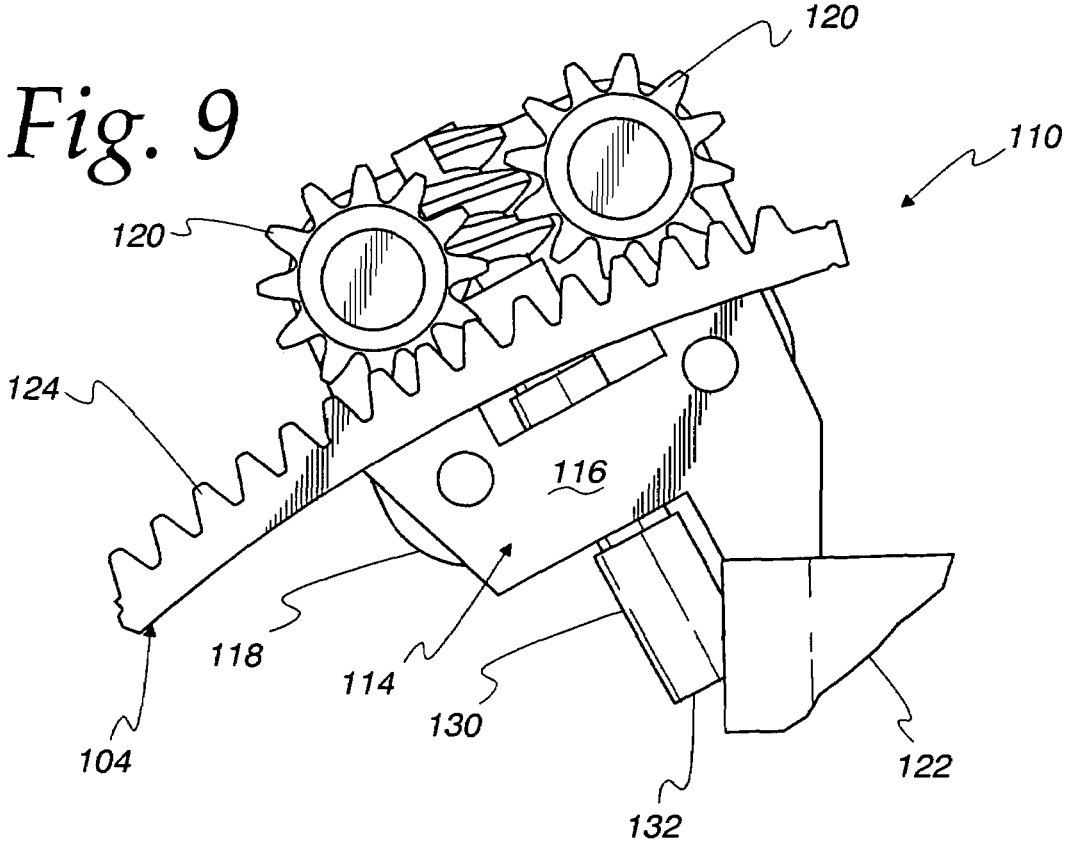

The socket mount 100 may also advantageously include a mounting leg 140 on which the dome 56 may be advantageously mounted. In such case, the dome 56 may include a slot 144 therein (see FIGS. 1, 4 and 5) through which wiring for the lamp socket 70 may pass to reach the control/power lines in the junction box 32. Since rotation of the ring 74 and attached socket mount 100 will thereby also turn the dome 56 and maintain its slot 144 in the same position relative to the supported socket 70, turning of the ring 74 in the fixture 20 will not twist up the cords but instead will maintain them in the desired position passing a short, direct distance from the socket 70 to the slot 144.

Also advantageously secured to the ring 74 for rotation therewith are arcuate frame members 150 about which suitable lighting members such as light emitting diodes (LEDs) 154 may be secured. Such LEDs 154 are directed upwardly to light the dome 56 without being directly visible to a person in the room. As previously described, the LEDs may be suitably controlled to not only control their light intensity but also the color of the light emitted so that to provide the effect desired with respect to the appearance of the dome 56 to a person in the room. As with the socket mount 100, since the LEDs 154 will rotate with the dome 56, their wiring may be securely retained to pass only the short distance from the end of the frame members 150 to the dome slot 144 and thereby remain hidden and not twisted even if the rotational position of the ring 74 should be adjusted.

Figure 2:
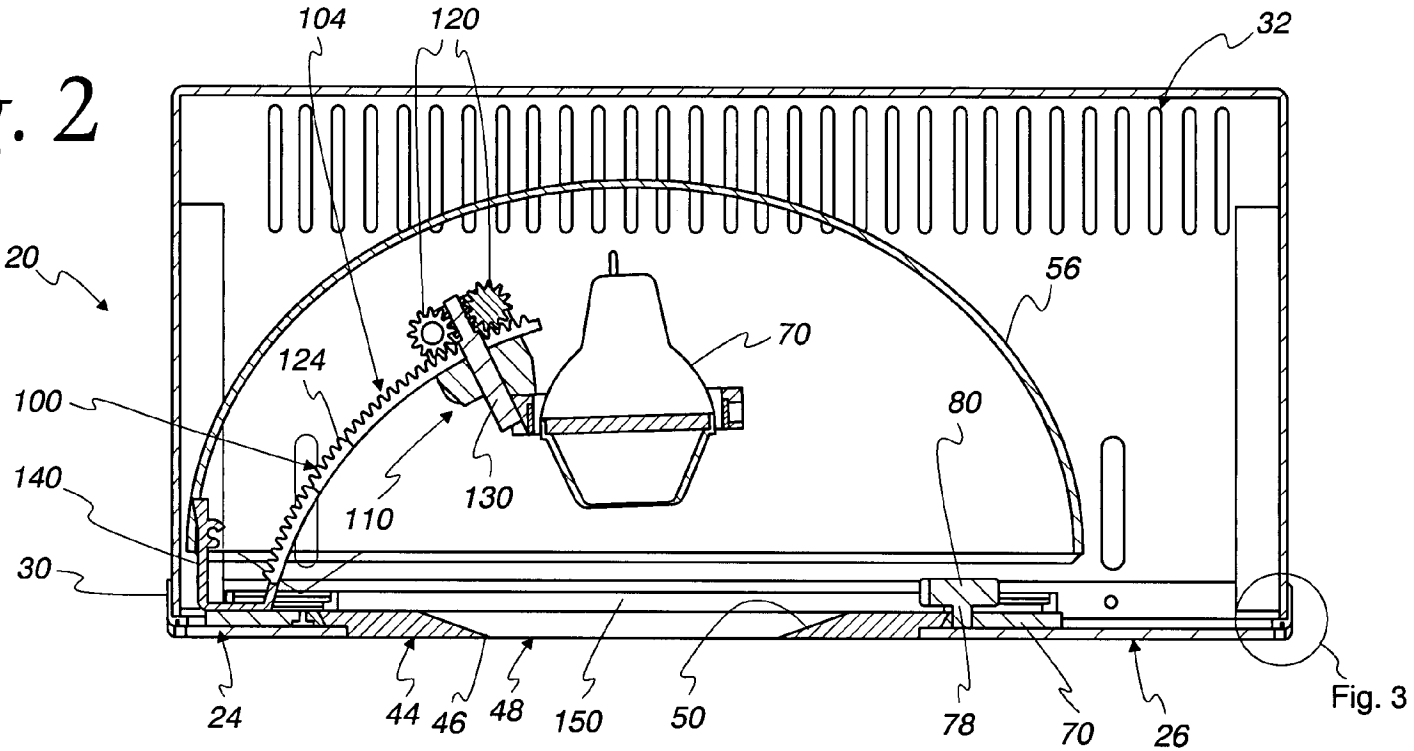
FIG. 2 is a side view of the light fixture of FIG. 1.

It should thus be appreciated that the ring 74 may be readily turned to essentially any desired position around the light opening 48 to accommodate different mounting locations for the fixture 20. For example, if the fixture 20 were mounted in a ceiling 34 with a wall adjacent the right end of the fixture 20 as illustrated in FIG. 2, the entire socket mount 100 structure would essentially be hidden from view in the room. That is, the socket mount 100 (particularly the track 104) could only be seen if viewed by a person who looks into the light opening 48 while standing several feet to the right of the fixture 20 in FIG. 2, and no one would actually be able to stand in such a position since it would be behind the wall. Moreover, even if someone were able to position themselves to that they could see into the fixture 20 at that angle, much of the socket mount 100, including the carriage 114, would be substantially hidden behind the lamp in any event. If, instead of being mounted with the wall to the right in FIG. 2 as discussed above, the fixture 20 were oriented so as to be positioned with a wall in front of the fixture 20 as viewed in FIG. 2, then the ring 74 could be turned ninety degrees to similarly orient the socket mount 100 away from the wall and thereby effectively hide the socket mount 100 in the same manner as described above. Such flexibility of positioning also allows the lamp to provide a spotlight or indirect lighting on the wall, as is often desired, no matter what orientation the fixture 20 is mounted in.

Though not shown in the Figures, it should be appreciated by those skilled in the art that suitable wire and control lines, and control circuits and transformers when needed for particular types of light sockets, may be provided and suitably secured to the junction box 32 and/or base plate 24. Except as illustrated and as disclosed herein, the particular wiring of the fixture 20 does not comprise the invention. Further, the invention does not require a particular kind of wiring (although, as noted herein, certain structural aspects of the invention do permit advantageous handling of the wires).

It should thus be appreciated that various features of the present invention will, both individually and in combination with other features, provide a recessed light fixture which may be readily installed and adjusted, and will provide striking visual effects. The sharp edge 46 of the light opening 48 assists in enabling the opening 48 to virtually disappear, and together with the dome 56 and adjustable socket mount 100 permit the fixture 20 to be readily configured in virtually any condition wherein the visual intrusiveness of the fixture 20 is minimized, and special effect appearances hiding the depth of the fixture 20 may also be achieved.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A recessed light fixture, comprising:

a base plate mountable in an opening in a room ceiling or wall, said base Plate defining spaced apart front and back surfaces wherein said front surface is substantially flat and aligned with the surface of said ceiling or wall when mounted thereon, and said back surface faces away from the room, and a light opening through said base plate wherein the edge of said light opening is a sharp edge with said back surface including a surrounding back surface substantially parallel to said front surface and a connecting back surface tapering away from said front surface around said light opening to said surrounding back surface; and a light socket mounted to said base plate back surface whereby a lamp in said socket emits light through said light opening.

2. The recessed light fixture of claim 1, wherein said back surface tapers from said front surface at an angle of less than 45 degrees.

3. The recessed light fixture of claim 2, wherein said back surface tapers from said front surface at an angle of about 15 degrees.

4. The recessed light fixture of claim 1, further comprising a curved dome adjacent said back surface of said base plate and centered on said light opening, wherein said light socket is between said curved dome and said base plate and said light socket is oriented to direct light out of said dome.

5. The recessed light fixture of claim 4, wherein said dome surface facing said base plate and said base plate front surface when mounted on said ceiling or wall have substantially the same color.

6. The recessed light fixture of claim 4, further comprising a plurality of light emitting diodes around said light opening and directed toward said curved dome.

7. The recessed light fixture of claim 6, further comprising a control for selecting the color of light emitted by said light emitting diodes.

8. The recessed light fixture of claim 1, further comprising a mount for said light socket comprising:

a support track secured on its lower end to said base plate and curved up and toward said light opening from its lower end; and a socket support mounted for adjustable movement on said support track relative to said base plate opening;

wherein said base plate light opening is fixed relative to the room opening, and said light socket is mounted to said socket support whereby a lamp in said socket is directed toward said base plate opening in all adjusted positions of said socket support to emit light out of said light opening.

9. The recessed light fixture of claim 8, wherein said track is a curved rack and said socket support comprises a pinion secured for movement along said rack in response to pivoting of said pinion.

10. The recessed light fixture of claim 9, further comprising a worm on said socket support engaging said pinion for pivoting thereof, said worm having a drive accessible through said light opening.

11. The recessed light fixture of claim 10, wherein said worm drive is a slotted head.

12. The recessed light fixture of claim 8, wherein said lower end of said support track is rotatable around said light opening.

13. The recessed light fixture of claim 12, further comprising a ring rotatably mounted to said base plate with said lower end of said support track secured to said ring.

14. The recessed light fixture of claim 13, further comprising LEDs on said ring emitting light away from said back plate.

15. The recessed light fixture of claim 14, further comprising a curved dome adjacent said back surface of said base plate and centered on said light opening, wherein said light socket is between said curved dome and said base plate and said light socket is oriented to direct light out of said dome.

16. The recessed light fixture of claim 8, wherein said track is curved substantially about the center of said light opening.

17. A recessed light fixture, comprising:

a base plate mountable in an opening in a room ceiling or wall, said base plate defining a light opening therethrough fixed relative to the room opening;

a support track secured on its lower end to said base plate and curved up and toward said light opening from its lower end;

a socket support mounted for adjustable movement on said support track and relative to said base plate light opening; and a light socket mounted to said socket support whereby a lamp in said socket is directed toward said base plate opening in all adjusted positions of said socket support and emits light out of said light opening.

18. The recessed light fixture of claim 17, wherein said track is a curved rack and said socket support comprises a pinion secured for movement along said rack in response to pivoting of said pinion.

19. The recessed light fixture of claim 18, further comprising a worm on said socket support engaging said pinion for pivoting thereof, said worm having a drive accessible through said light opening.

20. The recessed light fixture of claim 19, wherein said worm drive is a slotted head.

21. The recessed light fixture of claim 17, wherein said lower end of said support track is rotatable around said light opening.

22. The recessed light fixture of claim 21, further comprising a ring rotatably mounted to said base plate with said lower end of said support track secured to said ring.

23. The recessed light fixture of claim 22, further comprising LEDs on said ring emitting light away from said back plate.

24. A recessed light fixture, comprising:

a base plate mountable in an opening in a room ceiling or wall, said base plate defining spaced apart front and back surfaces wherein said front surface is substantially flat and aligned with the surface of said ceiling or wall when mounted thereon and said back surface faces away from the room, and a light opening through said base plate fixed relative to the room opening wherein the edge of said light opening is a sharp edge with said back surface including a surrounding back surface substantially parallel to said front surface and a connecting back surface tapering away from said front surface around said light opening to said surrounding back surface at an angle of less than 45 degrees;

a curved dome adjacent said back surface of said base plate and centered on said light opening;

a ring mounted to said base plate for selected rotation around said light opening;

a support track secured on its lower end to said ring and curved up and toward said light opening from its lower end, said support track being between said curved dome and said base plate;

a socket support mounted for adjustable movement on said support track and relative to said base plate light opening; and a light socket mounted to said socket support whereby a lamp in said socket is directed toward said base plate opening in all adjusted positions of said socket support and emits light out of said dome through said light opening.

25. The recessed light fixture of claim 24, wherein said track is an arcuate rack and said socket support comprises a pinion secured for movement along said rack in response to pivoting of said pinion.

26. The recessed light fixture of claim 25, further comprising a worm on said socket support engaging said pinion for pivoting thereof, said worm having a drive accessible through said light opening.

27. The recessed light fixture of claim 25, further comprising LEDs on said ring emitting light away from said back plate.

28. The recessed light fixture of claim 24, wherein said back surface tapers from said front surface at an angle of about 15 degrees.

* * * * *